US005497719A

United States Patent [19]

Henz et al.

[11] Patent Number: 5,497,719

[45] Date of Patent: Mar. 12, 1996

[54] STAND FOR AN EMBROIDERING MACHINE

[75] Inventors: Jürg Henz, Amriswil; Hans Abegglen; Yueliang Yu, both of Arbon, all of Switzerland

[73] Assignee: Saurer Sticksysteme AG, Arbon, Switzerland

[21] Appl. No.: 155,875

[22] Filed: Nov. 23, 1993

[30] Foreign Application Priority Data

Nov. 26, 1992 [DE] Germany ..... 42 39 746.4

[51] Int. Cl.[6] ..... D05C 3/04

[52] U.S. Cl. ..... 112/83

[58] Field of Search ..... 112/78, 80.3, 80.33, 112/102, 103, 217.1, 217.2, 117, 118, 119, 83, 84, 86, 90

[56] References Cited

U.S. PATENT DOCUMENTS

| | | | |
|---|---|---|---|
| 1,020,674 | 3/1912 | Zahn | 112/83 |
| 2,449,529 | 9/1948 | Hofmann | 112/80.33 X |
| 2,991,737 | 7/1961 | Newman | 112/83 X |
| 3,338,195 | 8/1967 | Kobelt | 112/83 |
| 3,680,505 | 8/1972 | Reich | 112/83 |

FOREIGN PATENT DOCUMENTS

| | | | |
|---|---|---|---|
| 0050396 | 8/1925 | Austria | 112/83 |
| 0543267 | 5/1956 | Italy | 112/83 |
| 50769 | 4/1910 | Switzerland | 112/83 |
| 25531 | of 1910 | United Kingdom | 112/83 |

*Primary Examiner*—C. D. Crowder
*Assistant Examiner*—Ismael Izaguirre
*Attorney, Agent, or Firm*—Keck, Mahin & Cate

[57] ABSTRACT

An embroidering machine includes a machine stand with a substantially U-shaped cross-section that is open at the top, and has at least two substantially vertical U-shaped frames (16) that are open at the top and are connected by longitudinal supports (3, 3a) and form a channel (14) that runs in the longitudinal direction of the machine and is open at least at the side ends. Shafts of a fabric stretching frame (10) are positioned in movable fashion in this channel. A further U-shaped frame, open at the bottom, may be arranged on top of the vertical U-shaped frames that are open at the top to form a substantially rectangular frame.

1 Claim, 2 Drawing Sheets

STAND FOR AN EMBROIDERING MACHINE

FIELD OF THE INVENTION

The present invention relates to an embroidering machine with a plurality of embroidering stations, particularly a machine stand at which the embroidering stations are horizontally positioned in one or several rows positioned on top of each other.

BACKGROUND OF THE INVENTION

In the past, this type of large embroidering machine with embroidery lengths of 10 m, 15 m to 21 m has had a two-story design, i.e., two horizontal rows of embroidering positions. Two corresponding fabric lengths being embroidered were positioned one above the other. This achieves twice the number of stitches per minute or per hour compared with a single-story machine. Since the embroidering height (the height of the material being embroidered in a stretcher) was increased from originally less than 40 cm to 120 cm or more, large embroidering machines have become increasingly taller. So as not to require extreme building heights and so as to permit reasonable servicing of the two stories, the machines were designed in such a way that a longitudinal trench in the foundation of the machine is provided in the center axis of the machine, into which the lower portion of the stretching frame can be dropped during embroidery.

As a consequence of this design, the front and back sides of the machine are separated by the trench, which has a depth of up to 1 m. The stability of the machine consequently cannot be assured by the frame, but must be assumed by the foundation. When the floor conditions are unfavorable, considerable expense may be necessary to provide a sufficiently rigid foundation. Insufficient rigidity of the foundation may lead to deformation of the machine, making further operation impossible.

This conventional design also necessitates that the machines be assembled at the site of operation, since a large embroidering machine forms a stable unit integrally with its foundation. Preassembly by the manufacturer is limited to small, self-contained structural units. Final assembly at the operational site may take from 6 to 12 weeks.

Any change in site of such large embroidering machines is an expensive undertaking. The machine must not only be disassembled, but must also be carefully removed from the foundation and reassembled on a new foundation at the new site.

Such a design, with a deep trench for the stretching frame, requires the front and back parts of the machine to be connected at either end with lateral shields. The result is that the sides become so built up that sideways introduction and removal of the fabric webs is difficult.

A two-story design is also the source of considerable difficulty in the maintenance of the machine. Gangways with landings and ladders or with platform lifts, along with the corresponding safeguards, must be installed to serve the upper story. The expense in terms of time and personnel is considerable.

SUMMARY OF THE INVENTION

The purpose of the invention is to develop a large embroidering machine of the type described which provides comparable performance at lower structural height and the need for an elaborate foundation can be eliminated.

An essential feature of the invention is the provision of a U-shaped frame, open in the upward direction. Thus the invention provides a single-story design which permits a series arrangement and which eliminates large structural heights having the disadvantages described above.

When a single-story, modular design is employed, another essential advantage is achieved in that performances equal to those of a two-story design are possible, since the frame according to the invention is operated at higher speeds than are possible with a two-story design.

Thus with a reduced structural height and the advantages provided by a modular design and with the elimination of an elaborate foundation, an embroidering machine according to the invention achieves a performance approximately equal to that of conventional embroidering machines with a two-story design.

With a single-story design or low embroidering heights with automated secondary undulation of the fabric webs in the stretching frame, the trench for the stretching frame can be eliminated. This permits a self-supporting design in which the front and back sides of the machine are rigidly connected. This kind of machine can be set up on any level floor capable of bearing weight and can easily be relocated. The costs for a special elaborate foundation are eliminated. Any influence exerted by irregularities in the floor surface can be corrected by adjusting the machine feet.

Independence from the foundation permits the preassembly of entire machine modules on a large scale. These can be rapidly combined on site and do not have to be cast into a complicated foundation. The relocation of such machines to new sites requires only a fraction of the effort formerly needed.

The U-channel of the machine frame, which is open on both sides, permits a stretching frame design in which the fabric being embroidered can be introduced on one side of the machine and removed from the other side.

Completing the upwardly open U-shaped section so as to form a tall, narrow rectangle provides a particularly rigid frame for guiding and moving the stretching frame and does so at little material expense.

The single-story design also provides an embroidering machine that is relatively high (2 m) when assembled on a level floor. This might entail special difficulties and increased costs for the transport of completely preassembled modules. By concentrating all embroidering tools and their drives in the lower portion of the stand frame according to the invention, the upper portion of the machine can be reduced to the guide elements for the stretching frame. Technically simple structures permit the upper part to be connected to the lower part in a detachable manner. Thus lower part modules, along with all embroidering positions requiring high precision assembly, can be completely preassembled and shipped, along with their drives. Only the vertical supports with the guide elements, or the upper part of the rectangular frame with the guide elements, need to be mounted at the site, along with the parts of the stretching frame. A design of this type allows the largest size of embroidering machine to be mounted and placed in operation in less than a week.

BRIEF DESCRIPTION OF THE DRAWINGS

The invention will now be described in greater detail on the basis of the figures depicting one embodiment of the invention. Further features and advantages of the invention will be apparent from the drawings and their description.

DETAILED DESCRIPTION OF THE PREFERRED EMBODIMENTS

Figure 1:
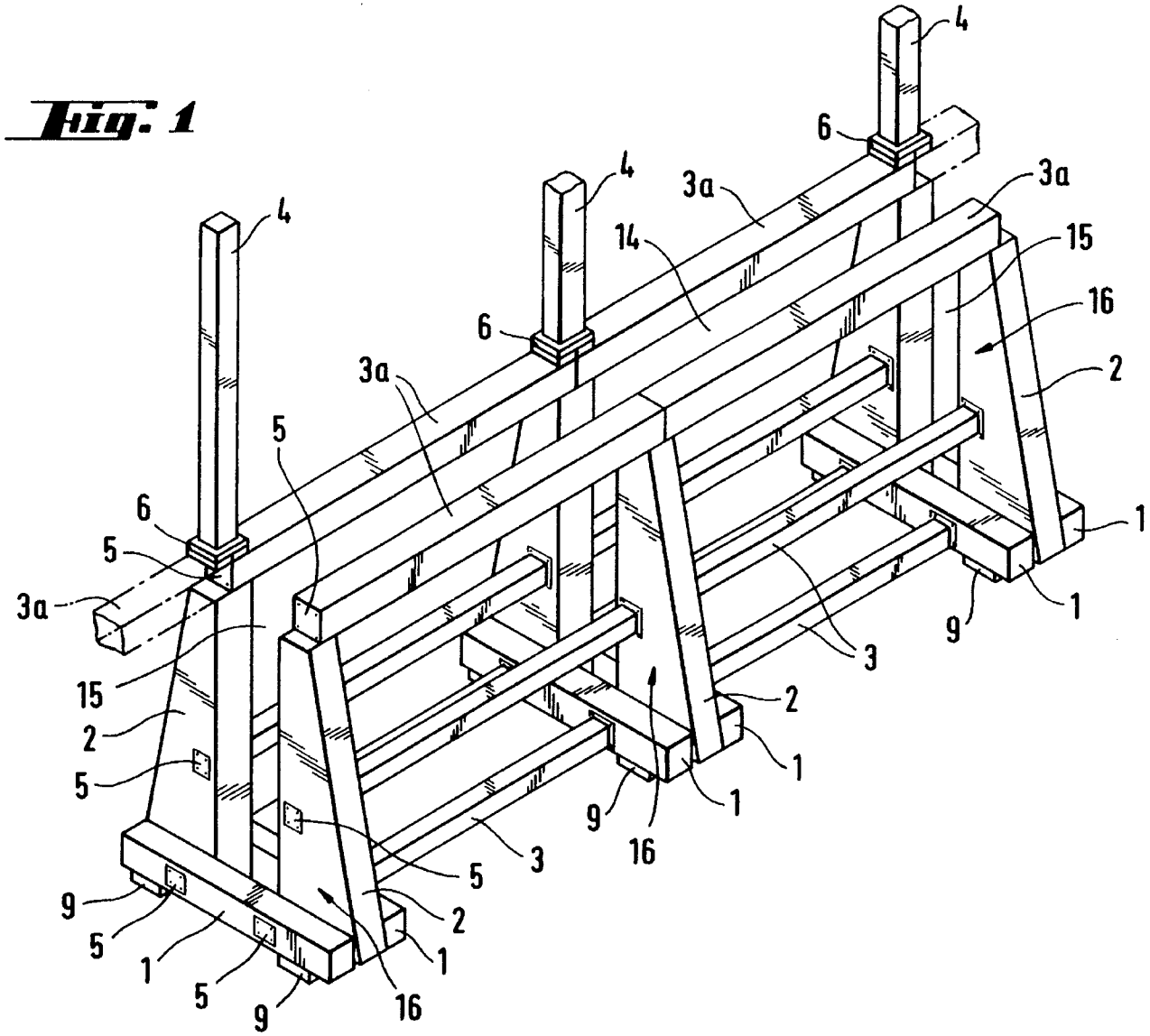
FIG. 1 is a perspective view of a machine stand of the invention, showing a preassembled module.

As shown in FIG. 1, the preassembled module consists of a lower support 1, which, used as a dual support, receives two side stands 2 within its two parts; in combination with the lower support 1 these side stands form a U-shaped frame that opens upward. The lower support 1 may also have a one-part design.

A plurality of these U-shaped frames are positioned in succession and are connected together by longitudinal supports 3 running perpendicular thereto. These longitudinal supports 3 are secured to the corresponding adjacent parts, such as to lower support 1 and side stands 2, for example, by screws.

The upper longitudinal supports 3 have faces designated as faces 3*a*. Embroidering tools, such as shuttles, needles, and drills, are positioned on these faces.

Figure 2:
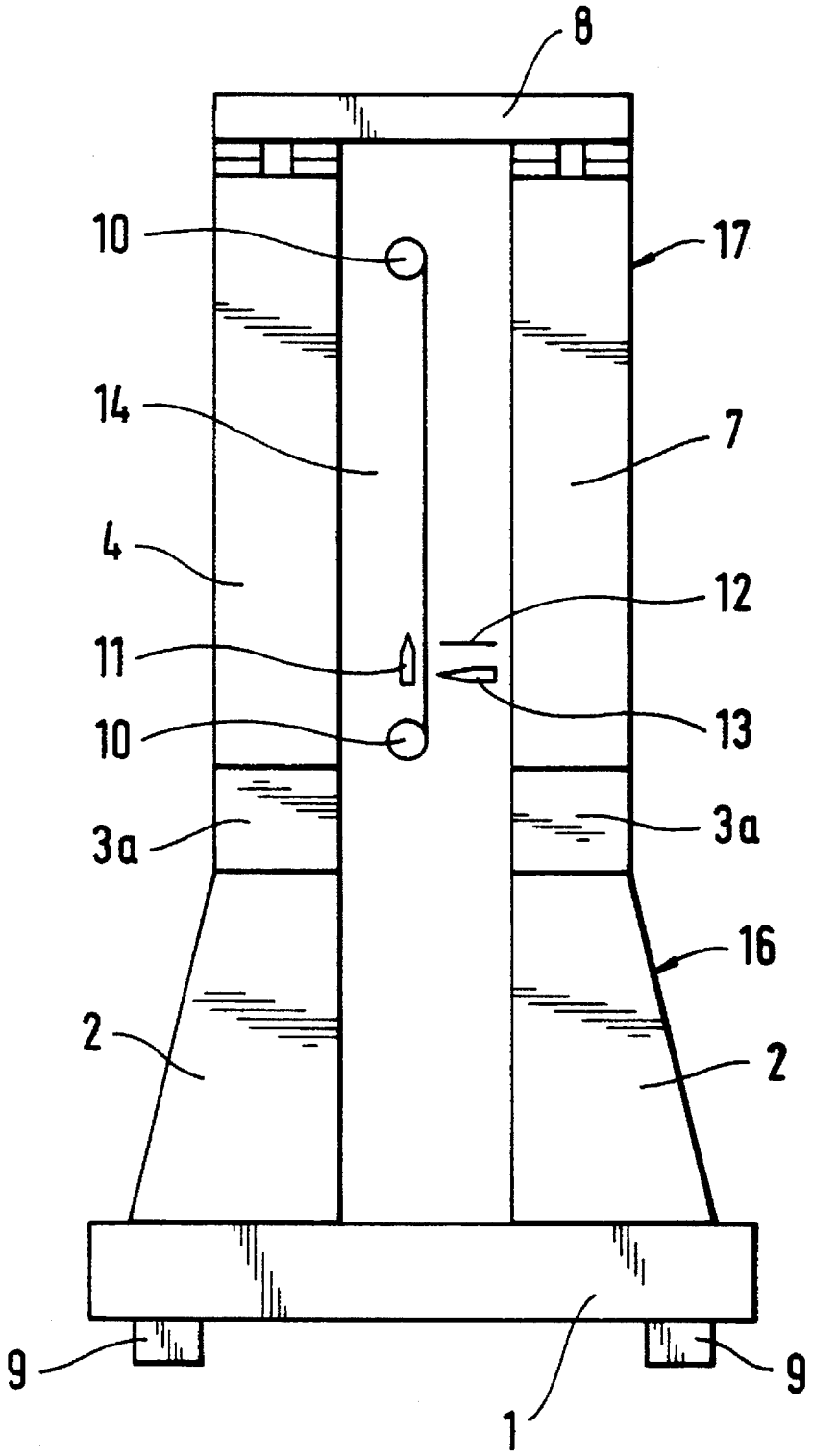
FIG. 2 is a side elevational view of a preassembled module of FIG. 1, including an upper U-shaped frame that is completed to form a closed framework.

The complete preassembled module has a central channel 14 running in a longitudinal direction. The shuttles, needles, and drills are positioned in the area of this channel, as indicated in FIG. 2.

With the stand frame open at the top and front it is possible for the first time to introduce the material being embroidered through the open side 14 of the channel to remove it from an end 15.

Secured to the upper face 3*a* are vertical supports 4 which, together with the faces 3*a*, form disconnecting points 6. These vertical supports 4 form the upper part of the machine and include guide elements for the stretching frame.

Further connections 5 are provided on the ends for other assembly modules; a single element of an attached assembly module is suggested by illustration of a face 3*a* shown in broken lines in FIG. 1.

The lower supports 1 of the preassembled module are mounted on foundation plates 9, which may take the form of vibration absorbers, having an adjustable height.

FIG. 2 shows a side view of a preassembled module of FIG. 1, enlarged by one upper U-shaped frame.

Secured to the faces 3*a* running longitudinally is a second U-shaped frame that is closed at the top, using the disconnecting points for the purpose of attachment. The upper U-shaped frame includes vertical supports 4 and lateral supports 7 running parallel thereto; the lateral supports 7 are connected to each other at upper ends thereof by transverse connecting elements 8.

The frame described has an optimal inherent rigidity, so that anchoring in a foundation is no longer necessary. Thus, an embroidering machine stand according to the invention includes a lower U-shaped frame that is open at the top. Placed on top of the lower U-shaped frame is an upper U-shaped frame, with the legs of each U-shaped frame facing each other and joined together.

Thus the frame is a closed, rectangular, relatively narrow frame with a channel 14 that passes through its center, in which two fabric shafts for the fabric stretching frame 10 are positioned in parallel fashion one on top of the other.

As stated above in the description, the individual tools, such as shuttles 11, needles 12, and drills 13, are positioned on the face 3*a* running in the longitudinal direction.

The invention thus relates to two different embodiments; in the first embodiment the embroidering machine may consist of only one preassembled U-shaped module open at the top; the frame already having the necessary inherent rigidity and vibrational stability.

In a second embodiment, which is also covered by the inventive concept, a U-shaped frame that is open at the top is completed by a second U-shaped frame that opens in the downward direction, to form a closed rectangular framework, making the stand even more rigid and stable.

In the simplest embodiment the invention thus consists of an U-shaped frame open at the top, and in a further embodiment a second U-shaped frame open at the bottom is added to this U-shaped frame open at the top. With the described module design the possibility is afforded for the first time of adding other preassembled modules, in accordance with FIG. 1, in the longitudinal direction. The disconnecting points 5 are suitable as attachment points.

While the invention has been described with respect to certain embodiments thereof, it will be appreciated by one skilled in the art that variations and modifications may be made without departing from the spirit and scope of the invention.

What is claimed is:

1. An elongated embroidering machine having an arrangement of a plurality of embroidering stations positioned adjacent to each other, each with a needle and embroidering tools, said machine being positioned on a machine stand in partially facing fashion on both sides of a fabric stretching frame, in one row or in several rows positioned vertically with respect to each other, wherein the machine stand has a frame having a substantially U-shaped cross-section that is open upwardly, said frame comprising at least two spaced apart vertical U-shaped frames (16) that are open upwardly and longitudinal supports (3, 3*a*) connecting said U-shaped frames to form a channel (14) in the lengthwise direction of the machine, said channel being open upwardly and open at ends (15) thereof an in which channel a fabric stretching frame (10) is movably positioned, wherein vertical supports (4) to guide and move the stretching frame are secured to the longitudinal supports (3*a*) connecting the U-shaped frames (16), and wherein the embroidering machine is self-supporting when standing on the floor.

* * * * *